US010695789B2

(12) United States Patent
Bosselmann et al.

(10) Patent No.: US 10,695,789 B2
(45) Date of Patent: Jun. 30, 2020

(54) STRIP PROCESSING DEVICE AND METHOD FOR PROCESSING A STRIP

(71) Applicants: THYSSENKRUPP STEEL EUROPE AG, Duisburg (DE); thyssenkrupp AG, Essen (DE)

(72) Inventors: Detlef Bosselmann, Hattingen (DE); Michael Nowak, Bochum (DE); Gerold Raspudic, Kreuztal (DE); Josef Schneider, Wenden (DE); Reinhard Täger, Kreuztal-Eichen (DE)

(73) Assignee: thyssenkrupp AG, Essen (DE)

( * ) Notice: Subject to any disclaimer, the term of this patent is extended or adjusted under 35 U.S.C. 154(b) by 5 days.

(21) Appl. No.: 15/759,995

(22) PCT Filed: Aug. 16, 2016

(86) PCT No.: PCT/EP2016/069365
§ 371 (c)(1),
(2) Date: Mar. 14, 2018

(87) PCT Pub. No.: WO2017/045848
PCT Pub. Date: Mar. 23, 2017

(65) Prior Publication Data

US 2019/0047013 A1 Feb. 14, 2019

(30) Foreign Application Priority Data

Sep. 15, 2015 (DE) ..... 10 2015 217 627

(51) Int. Cl.
*B05C 1/08* (2006.01)
*B05C 9/04* (2006.01)
(Continued)

(52) U.S. Cl.
CPC ..... *B05C 1/0834* (2013.01); *B05C 1/083* (2013.01); *B05C 1/0826* (2013.01);
(Continued)

(58) Field of Classification Search
CPC ..... B05C 1/0826–0834; B05C 9/04
See application file for complete search history.

(56) References Cited

U.S. PATENT DOCUMENTS 6,011,947 A * 1/2000 Acquaviva ..... B05C 1/0834 399/341
2007/0181284 A1 8/2007 Albrecht-Fruh et al.
(Continued)

FOREIGN PATENT DOCUMENTS

AU 2007271717 A 1/2008
CN 203370682 U * 1/2014
(Continued)

OTHER PUBLICATIONS

English Translation of International Search Report issued in PCT/EP2016/069365, dated Oct. 18, 2016 (dated Nov. 2, 2016).

*Primary Examiner* — Dah-Wei D. Yuan
*Assistant Examiner* — Stephen A Kitt
(74) *Attorney, Agent, or Firm* — RMCK Law Group PLC

(57) ABSTRACT

A device for processing a strip guided along a running direction may include a roller holder disposed on a base frame so as to be pivotable about a pivot axis oriented substantially parallel to a strip running surface. A first processing roller may be disposed on the roller holder in the running direction and at a distance from the pivot axis perpendicular to the running direction and offset from the pivot axis such that by pivoting the roller holder, the first processing roller is moved toward the strip and the processing roller is moved away from the strip. A first counter-processing roller may be disposed transversely to the running direction at a further distance from the pivot axis than the first processing roller such that the first processing and counter-processing rollers interact to guide the strip if the first processing roller is moved toward the strip.

13 Claims, 1 Drawing Sheet

(51) Int. Cl.
*B05D 1/28* (2006.01)
*B05D 7/14* (2006.01)

(52) U.S. Cl.
CPC ..... *B05C 1/0839* (2013.01); *B05C 9/04* (2013.01); *B05D 1/28* (2013.01); *B05D 7/14* (2013.01)

(56) References Cited

U.S. PATENT DOCUMENTS

| | | | |
|---|---|---|---|
| 2010/0068403 | A1 | 3/2010 | Fitch |
| 2010/0233505 | A1 | 9/2010 | Boger et al. |
| 2010/0300643 | A1 | 12/2010 | Albrecht-Frueh et al. |
| 2011/0293464 | A1 | 12/2011 | Abratis et al. |
| 2015/0072167 | A1 | 3/2015 | Stein-Fechner et al. |

FOREIGN PATENT DOCUMENTS

| | | | |
|---|---|---|---|
| CN | 203370682 | U | 1/2014 |
| DE | 4324052 | A | 1/1995 |
| DE | 19523274 | A | 1/1997 |
| DE | 19536964 | A | 4/1997 |
| DE | 102015104974 | B | 6/2016 |
| EP | 2759614 | A | 7/2014 |
| GB | 1073872 | A | 6/1967 |

* cited by examiner

STRIP PROCESSING DEVICE AND METHOD FOR PROCESSING A STRIP

CROSS REFERENCE TO RELATED APPLICATIONS

This application is a U.S. National Stage Entry of International Patent Application Serial Number PCT/EP2016/069365, filed Aug. 16, 2016, which claims priority to German Patent Application No. DE 10 2015 217 627.4, filed Sep. 15, 2015, the entire contents of both of which are incorporated herein by reference.

FIELD

The present disclosure generally relates to strip processing, including devices and methods for processing steel strip.

BACKGROUND

In order to process a strip, for example a metal strip such as, in particular, a steel strip, use is customarily made of a processing operation using the run-through principle. For this purpose, a strip runs through a processing region of a strip processing device along a strip running direction. The provision of more than only one processing roller which can be placed against a strip surface is desirable, for example to provide flexibility for a change between two rollers and/or to manage with little time expenditure for conversion when changing between two rollers.

An example of an embodiment of a strip processing device which allows the provision of more than only one processing roller which can be placed against a strip surface can be found in AU2007271717B2. The strip processing device which can be found in AU2007271717B2 is designed as a roller coater in which processing rollers used as coating rollers can be placed against a strip in order to uniformly apply a coating material to the strip. The embodiment which can be found in AU2007271717B2 comprises a number of three coating rollers which are brought alternately into contact with the strip in order to apply different or else identical coating solutions. However, the strip processing device as can be found in AU2007271717B2 has the disadvantage of a comparatively complex structure and operational mechanism. In particular, in addition to the processing rollers which can be placed against the strip, there is required a comparatively high number of counter-rollers and deflection rollers, thus resulting in the risk of maintenance-intensive operation in the system with high space requirement.

Thus a need exists for a strip processing device that allows the provision of more than only one processing roller that can be placed against a strip surface, but at least partially or substantially avoids the aforementioned disadvantages.

DETAILED DESCRIPTION

Figure 1C:
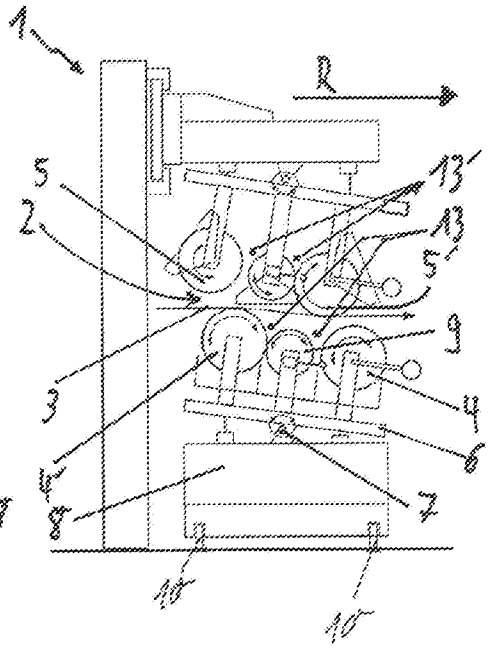
FIG. 1*c* is a side view of another example strip processing device.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art. Further, one or more features from the claims, the description, and the figures can be combined with one or more other features therefrom to give further embodiments. It is also possible for one or more features from the independent claims to be linked to one or more other features.

A strip processing device for processing a strip, which is guided in a processing region of the strip processing device, by means of a processing roller is proposed. The strip is guided along a strip running direction. The processing roller is designed such that it can be placed against the strip guided through the processing region.

The strip processing device comprises:

- a roller holder which is arranged on a base frame so as to be pivotable on a pivot axis, wherein the pivot axis is oriented parallel to a strip running surface,
- a first processing roller which is arranged on the roller holder in the strip running direction and at a distance from the pivot axis perpendicular to the strip running direction and offset from the pivot axis in such a way that, by means of pivoting the roller holder, the first processing roller can be moved toward the strip and the processing roller can be moved away from the strip,
- a first counter-processing roller which is arranged in a direction perpendicular to the strip running direction at a further distance from the first pivot axis than the first processing roller in such a way that the first processing roller and the first counter-processing roller interact to guide a strip guided in the processing region between the first processing roller and the first counter-processing roller if the first processing roller is moved toward the strip, wherein the first processing roller and the first counter-processing roller are arranged on the same roller holder.

The strip can be a metal strip, for example. In particular a steel strip can be provided. However a processing of other types of strips can also be provided, for example a plastic film in the form of a strip.

The concept of processing in this case comprises all types of processing which are customarily carried out with the aid of rollers. In particular, processing as coating, for example with a varnish, a solvent or some other coating material can be provided. However, all further possible types of processing strips can also be provided. In particular, a processing roller can be designed as a skin-pass roller for processing in the form of skin-pass rolling, for example of a steel strip. However, an additional or else exclusive guiding of a metal strip can also be encompassed by the concept of processing.

In order to ensure that it is possible to move the first processing roller toward the strip and away from the strip, a corresponding eccentric positioning of the first processing roller with respect to the pivot axis by means of arrangement on the roller holder is required as is also a correspondingly large degree of angular freedom for pivoting the roller holder and hence the first processing roller.

The design as described for a processing device in particular comprises the advantage that, by means of the same pivoting only of the roller holder, the first processing roller is moved toward the strip and thus processability of the guided-through strip is made possible via a simple and readily reproducible sequence, furthermore without significant time expenditure. In this case, the strip processing device providing these advantages has the advantage of comparatively few components to be moved, said components moreover being arranged in a relatively space-saving manner.

The pivot axis is oriented perpendicular to the strip running direction in such a way that the pivot axis is movable by an imaginary translational movement and without rotational movement into an imaginary area occupied by the strip. In other words, the pivot axis is oriented perpendicular to the strip running direction in such a way that both the pivot axis and a rectilinear extension of the pivot axis do not have an intersection with an area which contains the strip. The pivot axis is thus oriented parallel to a strip, the strip running surface, guided in the processing region of the strip processing device.

According to one embodiment of the strip processing device, there can be provision

- that the pivot axis is oriented parallel to the strip running surface and/or
- that the pivot axis is oriented parallel to the strip running surface and perpendicular to the strip running direction (R).

The thus resulting simplified structure of the strip processing device ensures a particularly simple structure of the strip processing machine and a simple ease of handling.

In one embodiment of the strip processing device, there can be provision for example that a ratio of a distance of the first processing roller from the first counter-processing roller in the strip running direction to a distance of the first processing roller from the first counter-processing roller perpendicular to the strip running direction are chosen such that the placement of the first processing roller against the strip and the interaction of the first processing roller with the first counter-processing roller can be brought about by means of pivoting the roller holder. In other words, the positions of the first processing roller and of the first counter-processing roller and the eccentricity of each of the first processing roller and the first counter-processing roller with respect to the pivot axis are configured such that the available degree of angular freedom for pivoting the roller holder about the pivot axis is sufficiently large in order, by means of the pivoting, to effect a mutually directed movement of the first processing roller and the second processing roller which thereby, in interaction with a roller mounting positioned upstream of the strip processing device and a roller mounting positioned downstream of the strip processing device, effects a tensioned guiding of the strip. Such a design for the strip processing device comprises the major advantage that, by means of the roller holder, only a pivoting of a single component is sufficient to bring about a tensioning of the strip for guidance that is sufficient for processing the guided strip.

In one advantageous development of the strip processing device, there can be provision for example that a second processing roller is arranged on the roller holder, wherein the first processing roller is arranged on a first side of the pivot axis and the second processing roller is arranged on a second side of the pivot axis, with the result that, by pivoting the roller holder, one of the first and the second processing roller can be moved toward the strip and the other of the first and the second processing roller can be moved away from the strip. Here, the first side and the second side of the pivot axis relate to at least one existing plane which comprises the pivot axis.

In a further advantageous development, there can be provision for example that the first processing roller, the second processing roller, the first counter-processing roller and a second counter-processing roller are arranged on the same roller holder. Furthermore, there can be provision that:

- a ratio of a distance of the first processing roller from the first counter-processing roller in the strip running direction to a distance of the first processing roller from the first counter-processing roller perpendicular to the strip running direction and
- a ratio of a distance of the second processing roller from the second counter-processing roller in the strip running direction to a distance of the second processing roller from the second counter-processing roller perpendicular to the strip running direction are chosen such that
- both the placement of the first processing roller against the strip and the interaction of the first processing roller with the first counter-processing roller
- and the placement of the second processing roller against the strip and the interaction of the second processing roller with the second counter-processing roller can be brought about by means of pivoting the roller holder. The advantage of such a design is that, by means of pivoting the roller holder, there can be a change from a first position in which the first processing roller and the first counter-processing roller interact into a second position in which the second processing roller and the second counter-processing roller interact. This effect can be used for example in an advantageous manner in the sense of doubling the service life; that is to say that in the event of wear of one of the two roller pairs, there can be a change-over by means of pivoting to use the other of the two roller pairs.

In one further design, there can be provision for example that the first processing roller and the second processing roller is arranged with mirror symmetry to a plane in which the pivot axis is situated, with the advantage of a particularly simple and elegant construction.

In one embodiment, there can furthermore be provision for example that

- there is arranged between the first processing roller and the second processing roller a first dip roller which, for example via a first axle adjustment mechanism for axle adjustment of the first dip roller, can be brought into contact with a coating material which is situated in a first reservoir situated below the first dip roller in order to provide the first processing roller and/or the second processing roller with the coating material by means of the first dip roller;

and/or

- there is arranged between the first counter-processing roller and the second counter-processing roller a second dip roller which, for example via a second axle adjustment mechanism for axle adjustment of the second dip roller, can be brought into contact with a coating material which is provided in a reservoir situated below the dip roller in order to provide the first counter-processing roller and/or the second counter-processing roller with the coating material by means of the second dip roller in order to provide the first counter-processing roller and/or the second counter-processing roller with the coating material by means of the second dip roller.

The axle adjustment mechanism for axle adjustment of the dip roller structurally provides a suitability of the strip processing device as a coating device.

In one advantageous development of the strip processing device, there can be provision for example that the axis of rotation of one or more rollers designed as processing rollers, counter-processing rollers and/or dip rollers is arranged on a respective adjustable axle holder for adjusting the rollers relative to one another. This achieves the advantage for example that a contact can be produced between the first dip roller and one or both of the processing rollers and/or a contact can be produced between the second dip roller and one or both of the counter-processing rollers. The construction such as this advantageously ensures that a placement of the dip rollers against the processing rollers can be individually set in dependence on a respective position of the processing rollers and in dependence on a coating material to be applied. A further advantage is that the guidance of the strip to be processed can also be influenced to a certain degree, with the result that, depending on the material of the strip to be processed and/or also depending on the positioning of the strip processing device in the processing process, a guide route of the strip which is as advantageous as possible can be set.

In order, if required, also to provide alternative or additional possibilities of feeding coating material to one or more processing rollers or counter-processing rollers, there can be provision that a first coating material feedline is arranged in an upper intermediate region between the first dip roller and at least one of the processing rollers and/or that a second coating material feedline is arranged in an upper intermediate region between the second dip roller and at least one of the counter-processing rollers. In one simple embodiment, the coating material feedline provided can be for example a pipe which is provided with openings through which a coating material can issue.

A further, independent concept of the invention provides a method for processing a strip, in particular a steel strip. The method comprises the following steps:

positioning the strip in a processing region of the strip processing device, placing a first processing roller arranged on a roller holder against a strip by means of the pivoting of the roller holder about a pivot axis, wherein the roller holder is pivotably arranged on a base frame of the processing preliminary guide so as to be pivotable about the pivot axis, and wherein the pivot axis is oriented substantially parallel to a strip running surface of the strip, wherein the first processing roller is positioned eccentrically with respect to the pivot axis in such a way that the pivoting brings about the placement and a first counter-processing roller is placed, in an identical pivoting operation with the placement of the first processing roller, against the other of the two strip surfaces by the first counter-processing roller being positioned eccentrically with respect to the pivot axis in such a way that the pivoting brings about the placement of the first counter-processing roller, wherein the first processing roller and the first counter-processing roller are arranged on the same roller holder.

In one preferred design, in order to allow expedient pivotability, the strip oriented perpendicular to the strip running direction is oriented in such a way that a straight line in which the pivot axis is situated and an area in which the strip is situated do not have an intersection; the pivot axis is thus oriented parallel to a strip that is guided in the processing region of the strip processing device.

According to one embodiment of the strip processing device, there can be provision that the pivot axis is oriented parallel to the strip running direction and/or that the pivot axis is oriented parallel and perpendicular to the strip running direction (R). The thus produced higher degree of symmetry ensures a particularly simple structure of the strip processing machine and a simple ease of handling.

In particular, there can be provision that one or more rollers can be set independently of one another in the direction of rotation and/or in rotational speed.

A further, independent concept of the invention provides the use of a strip processing device, in particular of an embodiment of the strip processing device according to the features explained at the outset, for coating a strip in a direction of rotation of the processing roller that follows a strip running direction or in a direction of rotation of the processing roller that is opposed to a strip running direction.

Specific embodiments of the invention are more fully explained in detail below with reference to the figures. The figures and accompanying description of the resulting features are not to be read as limiting to the respective embodiments but serve to illustrate the exemplary embodiment. Furthermore, the respective features can be used with one another and also with features of the above description for possible further developments and improvements of the invention, specifically in additional embodiments which are not illustrated.

Figure 1B:
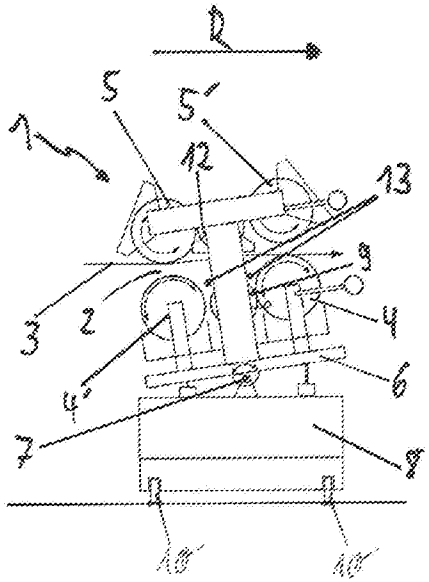
FIG. 1*b* is a side view of the example strip processing device of FIG. 1*a* in a pivoted state with placement of an example first strip processing roller and an example first counter-processing roller against the strip to be processed.
Figure 1A:
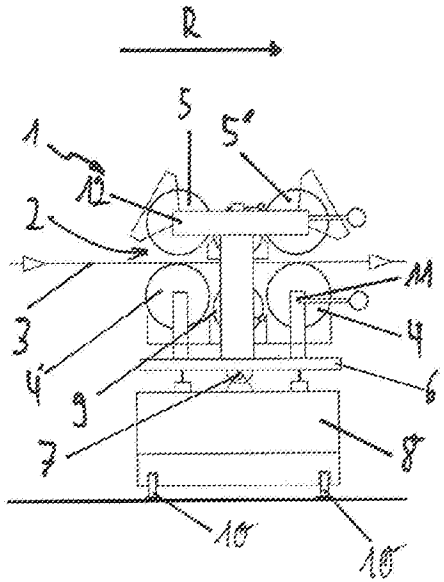
FIG. 1*a* is a side view of an example strip processing device in a non-placement state.

FIG. 1*a* is a first exemplary embodiment of a strip processing device 1 which is designed as a roller coater and which is suitable in particular for coating steel strip with a coating material, for example a varnish. The strip processing device comprises a base frame 8 which, in the embodiment illustrated, is equipped with rollers 10 in order to make it possible for the base frame 8 and hence the strip processing device 1 to be able to be moved. A roller holder 6 is arranged on the base frame 8, with the roller holder 6 being designed to be pivotable about a pivot axis 7. Here, the pivot axis 7 is oriented in such a way that a strip 3 guided through a processing region 2 of the strip processing device 1 is directed parallel to the strip running surface of the guided strip 3. Furthermore, in the design shown, the strip processing device 1 comprises a first processing roller 4 designed as a coating roller. The first processing roller 4 is held by the roller holder 6 and mounted eccentrically with respect to the pivot axis 7 of the roller holder 6. Along the strip running direction R illustrated by the arrow R, the first processing roller 4 is arranged downward in the running direction, whereas the distance of an axis of rotation 11 of the first processing roller 4 from the area in which the strip 3 is situated is less than the distance of the pivot axis 7 from this area. As a result of this positioning, the first processing roller 4 is arranged on the roller holder 6 in the strip running direction R and at a distance from the pivot axis 7 perpendicular to the strip running direction R in such a way that, by means of a pivoting of the roller holder 6 about the pivot axis 7, the first processing roller 4 can be moved toward the strip 3 and can be moved away from the strip 3. Furthermore in the design shown, the strip processing device 1 comprises a counter-processing roller 5. In the embodiment shown, an axis of rotation 12 of the counter-processing roller 5 is oriented parallel to the pivot axis 7, wherein the distance of the axis of rotation 12 of the counter-processing roller 5 counter to the strip running direction R is approximately similar to the distance of the axis of rotation 11 of the processing roller 4 along the strip running direction R. In this exemplary embodiment, the distance of the axis of rotation 12 of the counter-processing roller 5 from the strip 3 running in the processing region 2 is, in the non-placement state shown, approximately equal to the distance of the axis of rotation 11 of the processing roller 4 from the strip 3, wherein the strip 3 extends between the two rollers. Furthermore, the ratio of the distance of the first processing roller 4 from the first counter-processing roller 5 in the strip running direction R to a distance of the first processing roller 4 from the first counter-processing roller 5 perpendicular to the strip running direction R, in this case in a perpendicular to a plane contained the strip, is chosen such that, given the pivot angle resulting via the position of the pivot axis 7 and the structural design of the roller holder 6, the pivoting of the roller holder 6 causes the first processing roller 4 to be moved toward the strip 3 and the same movement of the roller holder 6 results in the first counter-processing roller 5 being moved toward the strip 3, with the result that finally a state can be reached in which the first processing roller 4 and the first counter-processing roller 5 are placed against the strip 3 and interact inter alia to guide the strip 3. This state of the strip processing device 1 with a placement both of the first processing roller 4 and of the first counter-processing roller 5 against the strip 3, wherein the strip 3 is guided between the first processing roller 4 and the first counter-processing roller 5 by said rollers, can be seen in FIG. 1*b*. The processing roller 4 and the counter-processing roller 5 interact to guide the strip 3, it being the case here that the interaction has the effect of maintaining and ensuring this tensioned state of the strip 3. Furthermore, the embodiment of the strip processing device 1 that can be seen in FIG. 1*a* comprises a second processing roller 4' and a second processing roller 5' which are both arranged on the same roller holder 6 on which there are also already arranged the first processing roller 4 and the first counter-processing roller 5. In the design illustrated the arrangement of the processing rollers 4, 4' and the counter-processing rollers 5, 5' is arranged with mirror symmetry to a plane in which the pivot axis is situated. It is possible by means of pivoting the roller holder 6 to change from a first state with a placement of the first processing roller 4 and the first counter-processing roller 5 against the strip according to the illustration of FIG. 1*b* to a second state with a placement of the second processing roller 4' and the second counter-processing roller 5' against the strip. In a case in which the first processing roller 4 and the second processing roller 4' and also the first counter-processing roller 5 and the second counter-processing roller 5' are each of the same type, it is thereby possible to double the service life of the strip processing device 1 designed as a roller coater, wherein a conversion time during a change from the first state to the second state is virtually not required, if at all, or a change of the coating material can take place with only very short set-up times. FIGS. 1*a* and 1*b* furthermore also depict dip rollers 9, 12 whose axle holder is adjustable, with the result that a positioning of the dip rollers 9, 12 can be carried out which can result in a removal of coating material from the reservoir situated below the dip rollers 9, 12 and it being passed on to the processing rollers 4, 4' or counter-processing rollers 5, 5'. For alternative or supplementary feeding of coating material, FIG. 1*b* and FIG. 1*c* also depict coating material feedlines 13, 13'.

FIG. 1*c* depicts an embodiment of a strip processing device 1 which differs from the embodiment of FIG. 1*a* and of FIG. 1*b* in particular in that a pivotability of the processing rollers 4 and 4' about a pivot axis 7 and a pivotability of the counter-processing rollers 5, 5' are decoupled from one another.

What is claimed is:

1. A strip processing device for processing a strip that is guided in a processing region of the strip processing device along a strip running direction, the strip processing device comprising:

a roller holder disposed on a base frame so as to be pivotable on a pivot axis, wherein the pivot axis is oriented parallel to a strip running surface;

a first processing roller disposed on the roller holder in the strip running direction and at a distance from the pivot axis perpendicular to the strip running direction, wherein the first processing roller is offset from the pivot axis such that by pivoting the roller holder the first processing roller is movable toward or away from the strip;

a second processing roller disposed on the roller holder, wherein the first processing roller is disposed on a first side of the pivot axis and the second processing roller is disposed on a second side of the pivot axis, wherein pivoting the roller holder in a first direction moves the first processing roller towards the strip and moves the second processing roller away from the strip; and a first counter-processing roller disposed on the roller holder and in a direction perpendicular to the strip running direction at a distance that is farther from the pivot axis than the first processing roller such that the first processing roller and the first counter-processing roller interact to guide the strip in the processing region between the first processing roller and the first counter-processing roller if the first processing roller is moved toward the strip;

wherein the first processing roller and the first counter-processing roller collectively move together on the base frame about the pivot axis in a first direction toward the strip and in a second direction away from the strip.

2. The strip processing device of claim 1 wherein a ratio of a distance of the first processing roller from the first counter-processing roller in the strip running direction to a distance of the first processing roller from the first counter-processing roller in a direction perpendicular to the strip running direction is such that placement of the first processing roller against the strip and the interaction of the first processing roller and the first counter-processing roller are effected by pivoting the roller holder.

3. The strip processing device of claim 1 wherein the first processing roller and the second processing roller are disposed with mirror symmetry in a plane in which the pivot axis is disposed.

4. The strip processing device of claim 1, further comprising:

a first dip roller disposed between the first processing roller and the second processing roller, wherein via an axle adjustment mechanism for axle adjustment of the first dip roller, the first dip roller is configured to contact a coating material disposed in a first reservoir below the first dip roller to provide at least one of the first processing roller or the second processing roller with the coating material by way of the first dip roller.

5. The strip processing device of claim 1, further comprising:

a first dip roller disposed between the first processing roller and the second processing roller, wherein the first dip roller is configured to contact a coating material disposed in a first reservoir below the first dip roller to provide at least one of the first processing roller or the second processing roller with the coating material by way of the first dip roller; and a second dip roller disposed between the first counter-processing roller and the second counter-processing roller, wherein the second dip roller is configured to contact a coating material disposed in a second reservoir below the second dip roller to provide at least one of the first counter-processing roller or the second counter-processing roller with the coating material by way of the second dip roller, wherein an axis of rotation of at least one of the first processing roller, the second processing roller, the first counter-processing roller, the second counter-processing roller, the first dip roller, or the second dip roller coincides with a respective axle adjustment mechanism for adjusting the at least one of the first processing roller, the second processing roller, the first counter-processing roller, the second counter-processing roller, the first dip roller, or the second dip roller relative to one another.

6. The strip processing device of claim 1, further comprising:

a second counter-processing roller, wherein the first processing roller, the second processing roller, the first counter-processing roller, and the second counter-processing roller are disposed on the roller holder, wherein a ratio of a distance of the first processing roller from the first counter-processing roller in the strip running direction to a distance of the first processing roller from the first counter-processing roller in a direction perpendicular to the strip running direction, and a ratio of a distance of the second processing roller from the second counter-processing roller in the strip running direction to a distance of the second processing roller from the second counter-processing roller in the direction perpendicular to the strip running direction are configured such that placement of the first processing roller against the strip and the interaction of the first processing roller with the first counter-processing roller, and such that placement of the second processing roller against the strip and an interaction of the second processing roller with the second counter-processing roller are effected by pivoting the roller holder.

7. The strip processing device of claim 6, further comprising:

a second dip roller disposed between the first counter-processing roller and the second counter-processing roller, wherein via an axle adjustment mechanism for axle adjustment of the second dip roller, the second dip roller is configured to contact a coating material disposed in a second reservoir below the second dip roller to provide at least one of the first counter-processing roller or the second counter-processing roller with the coating material by way of the second dip roller.

8. The strip processing device of claim 6, further comprising:

a first dip roller disposed between the first processing roller and the second processing roller, wherein via a first axle adjustment mechanism for axle adjustment of the first dip roller, the first dip roller is configured to contact a coating material disposed in a first reservoir below the first dip roller to provide at least one of the first processing roller or the second processing roller with the coating material by way of the first dip roller; and a second dip roller disposed between the first counter-processing roller and the second counter-processing roller, wherein via a second axle adjustment mechanism for axle adjustment of the second dip roller, the second dip roller is configured to contact a coating material disposed in a second reservoir below the second dip roller to provide at least one of the first counter-processing roller or the second counter-processing roller with the coating material by way of the second dip roller.

9. The strip processing device of claim 8 comprising at least one of:

a first coating material feedline disposed in a region between the first dip roller and at least one of the first processing roller or the second processing roller; or a second coating material feedline disposed in a region between the second dip roller and at least one of the first counter-processing roller or the second counter-processing roller.

10. The strip processing device of claim 1 wherein the pivot axis is perpendicular to the strip running direction.

11. The strip processing device of claim 6 wherein the second processing roller and the second counter-processing roller collectively move together on the base frame about the pivot axis in a third direction toward the strip and a fourth direction away from the strip, wherein the first and fourth directions occur concurrently and the second and third directions occur concurrently.

12. A strip processing device for processing a strip that is guided in a processing region of the strip processing device along a strip running direction, the strip processing device comprising:

a roller holder disposed on a base frame so as to be pivotable on a pivot axis;

a first processing roller disposed on the roller holder in the strip running direction and at a distance from the pivot axis perpendicular to the strip running direction, wherein the first processing roller is offset from the pivot axis such that by pivoting the roller holder the first processing roller is movable toward or away from the strip;

a second processing roller disposed on the roller holder, wherein the first processing roller is disposed on a first side of the pivot axis and the second processing roller is disposed on a second side of the pivot axis, wherein pivoting the roller holder in a first direction moves the first processing roller towards the strip and moves the second processing roller away from the strip; and a first counter-processing roller disposed on the roller holder such that the first processing roller and the first counter-processing roller interact to guide the strip in the processing region between the first processing roller and the first counter-processing roller if the first processing roller is moved toward the strip;

wherein the first processing roller, the second processing roller and the first counter-processing roller are disposed on the roller holder for concurrent movement based on pivoting of the roller holder about the pivot axis.

13. The strip processing device of claim 12, further comprising:

a second counter-processing roller, wherein the first processing roller, the second processing roller, the first counter-processing roller, and the second counter-processing roller are disposed on the roller holder, wherein a ratio of a distance of the first processing roller from the first counter-processing roller in the strip running direction to a distance of the first processing roller from the first counter-processing roller in a direction perpendicular to the strip running direction, and a ratio of a distance of the second processing roller from the second counter-processing roller in the strip running direction to a distance of the second processing roller from the second counter-processing roller in the direction perpendicular to the strip running direction are configured such that placement of the first processing roller against the strip and the interaction of the first processing roller with the first counter-processing roller, and such that placement of the second processing roller against the strip and an interaction of the second processing roller with the second counter-processing roller are effected by pivoting the roller holder.

* * * * *